US006515121B1

(12) United States Patent
Mackiewicz et al.

(10) Patent No.: US 6,515,121 B1
(45) Date of Patent: Feb. 4, 2003

(54) METHOD OF MANUFACTURING AND COLLECTING CELLULOSIC PARTICLES

(75) Inventors: Andrzej Marek Mackiewicz, Rugby (GB); Guy Edward Scudder, Coventry (GB); Sabine Seddon, Dudley (GB)

(73) Assignee: Acordis Kelheim GmbH, Kelheim (DE)

( * ) Notice: Subject to any disclaimer, the term of this patent is extended or adjusted under 35 U.S.C. 154(b) by 0 days.

(21) Appl. No.: 09/600,342

(22) PCT Filed: Jan. 14, 1999

(86) PCT No.: PCT/GB99/00031

§ 371 (c)(1), (2), (4) Date: Sep. 11, 2000

(87) PCT Pub. No.: WO99/36604

PCT Pub. Date: Jul. 22, 1999

(30) Foreign Application Priority Data

Jan. 15, 1998 (GB) ..... 9800850

(51) Int. Cl.[7] ..... C07G 17/00; C07H 1/00; C07H 3/00; C08B 37/00

(52) U.S. Cl. ..... 536/124; 536/56; 536/57; 536/58; 536/59; 536/60; 536/61

(58) Field of Search ..... 536/1.11, 56, 57, 536/59, 60, 61, 124, 58

(56) References Cited

U.S. PATENT DOCUMENTS 3,114,747 A * 12/1963 Campbell ..... 260/212
4,309,291 A * 1/1982 Probstein et al. ..... 210/713
5,071,599 A 12/1991 McNair, Jr.
5,529,585 A * 6/1996 Schrell et al. ..... 8/543
5,891,370 A 4/1999 Connor et al. ..... 264/37.2
6,080,277 A * 6/2000 Oberkofler et al. ..... 162/157.6

FOREIGN PATENT DOCUMENTS

| | | |
|---|---|---|
| EP | 0 692 559 A1 | 1/1996 |
| EP | 0 824 105 A2 | 2/1998 |
| EP | 0 824 106 A2 | 2/1998 |
| WO | WO 96/18761 | 6/1996 |
| WO | WO 96/26220 | 8/1996 |
| WO | WO 99/36602 | 7/1999 |
| WO | WO 99/36603 | 7/1999 |

OTHER PUBLICATIONS

One page English language Document Bibliography and Abstract for EP 0 824 105 A2 from esp@cenet database.

One page English language Document Bibliography and Abstract for EP 0 824 106 A2 from esp@cenet database.

* cited by examiner

*Primary Examiner*—James O. Wilson
*Assistant Examiner*—Patrick Lewis
(74) *Attorney, Agent, or Firm*—Howson and Howson

(57) ABSTRACT

Cellulosic fibrids can be made by mixing together under turbulent conditions viscose and a coagulating and regenerating liquor containing preformed fibrids to form a suspension of fibrids in a spent liquor, and collecting the fibrids from the spent liquor.

19 Claims, No Drawings

METHOD OF MANUFACTURING AND COLLECTING CELLULOSIC PARTICLES

This application is a 371 of PCT/GB99/00031 filed Jan. 14, 1999.

FIELD OF THE INVENTION

This invention relates to methods for the manufacture and collection of cellulosic particles of the kind known as fibrids.

Cellulosic fibrids can be made by mixing together under turbulent conditions a spinning solution of cellulose and a coagulating liquor. One example of such a solution is viscose, which contains sodium cellulose xanthate. Examples of coagulating liquors for viscose include aqueous salt solutions and aqueous acid solutions. The fibrids so produced comprise, often predominantly, fine fibrous particles a few microns in diameter; of comparable size to the fibres in woodpulp. These fibrids may also comprise plate-like or globular particles of similar size to those fibres and of more or less irregular shape. For example, in the familiar salt figure test for viscose ripeness, viscose is mixed with aqueous sodium chloride. If the sodium chloride concentration is too low, a solution is formed; if it is too high, a more or less coherent precipitated lump is formed; but at the correct concentration, fibrids are formed. The fibrids formed in the salt figure test contain residual xanthate groups. If such fibrids are acidified, or if an acidic coagulating liquor is used, then the xanthate groups are destroyed and cellulose is regenerated.

BACKGROUND ART

Modified cellulose particles have been proposed as additives in papermaking, in particular to assist in formation of the paper web (sheet) and in sludge dewatering. In a series of papers in Das Papier (1980, vol. 34, pp. 575–579; 1981, vol. 35, pp. V33–V38 and pp. 555–562; and 1983, vol. 37, pp. 181–185), Käufer et al. disclose cationically-modified cellulose particles prepared by the reaction of woodpulp with reagents such as 3-chloro-2-hydroxypropyltrimethylammonium chloride and the use of such particles as additives in papermaking.

Philipp and Lang (Faserforschung und Textiltechnik, 1966, vol. 17, pp. 299–304) disclose the addition of poly (ethyleneimine) to diluted viscose and titration of the resulting mixture with aqueous acid. A precipitate formed at mildly or moderately alkaline pH (8–11), depending upon the exact experimental conditions. The precipitate was described as a floc, indicating that it was composed of fibrids. The first-formed precipitate was believed to comprise a salt of a polymeric cation (protonated poly (ethyleneimine)) and a polymeric anion (cellulose xanthate). The authors refer to such salts generically as "symplexes". Titration was continued until the mixture became acid (pH 3), and at least partial regeneration of cellulose xanthate to cellulose occurred, thus yielding cationically-modified cellulosic particles by a viscose process. Philipp and co-workers elsewhere propose the use of cationically-modified cellulose particles and symplexes as additives for use in papermaking (Dawydoff et al., Acta Polymerica, 1987, vol. 38, pp. 307–313, and Philipp et al., Progress in Polymer Science, 1989, vol. 14, pp. 91–172).

WO-A-96/26220 discloses a process in which a cationic polymer is added to diluted viscose and the resulting mixture is mixed with a coagulating and regenerating liquor such as dilute sulphuric acid to form cellulosic fibrids useful as additives in papermaking. The viscose was added to the coagulating liquor, or vice versa. The resulting slurry contained about 0.3, 0.5 or 1 percent of fibrids, and the fibrids were collected from it by filtration.

Cellulosic fibrids may be collected from the aqueous slurry in which they are prepared by conventional methods such as settling, filtration and centrifugation. The cost of such collection varies inversely with the concentration of fibrids in the slurry. It is accordingly desirable on economic grounds to prepare slurries which contain high proportions of fibrids. Simple mixing, of the kind disclosed by Philipp and co-workers or in WO-A-96/26220, is not well-suited to the manufacture of slurries containing more than about 1 percent by weight of fibrids. These slurries are thick, semi-fluid, porridge-like materials which are difficult to mix. In consequence, coagulation of viscose in a concentrated fibrid slurry carries the risk of coagulation occurring unevenly, resulting in the production of hard oversized particles rather than the desired fibrids. It is an object of the invention to provide a convenient method of manufacturing concentrated fibrid slurries.

DISCLOSURE OF THE INVENTION

According to the invention, there is provided a method for the manufacture of cellulosic fibrids by the viscose process, including the steps of:

(1) mixing together (a) viscose and (b) a coagulating and regenerating liquor under turbulent conditions, thereby forming a suspension of cellulosic fibrids in a spent liquor; and (2) collecting the fibrids from the spent liquor, characterised in that the coagulating and regenerating liquor supplied into step (1) contains cellulosic fibrids withdrawn from step (1). The expression "spent liquor" is used as a convenient name for the byproduct liquor produced in the method of the invention; it will be appreciated that this liquor often retains some coagulating and regenerating powers.

We have found it convenient to employ a conventional viscose suitable for fibre manufacture and, prior to its introduction into mixing step (1), to dilute it with water to reduce its cellulose content to a value in the range from 1 to 4 percent by weight. If desired, such a conventional viscose may be diluted with a slightly acidic liquor, for example with a liquor which includes a proportion of spent bath; provided that this does not result in undue precipitation. This may offer advantages in terms of process economy.

The coagulating and regenerating liquor may be any of those known for viscose processes, particularly aqueous acid. Conveniently, it is dilute aqueous sulphuric acid, which is the most usual acidic component in such liquors, preferably at a concentration in the range from 0.5 to 5, more preferably from 1 to 3.5, percent by weight. If desired, the liquor may contain conventional amounts of sodium sulphate (a byproduct of the process), for example up to 25 percent by weight. This is advantageous, because the liquor can accordingly be recovered for reintroduction into the process using conventional measures such as evaporation and crystallisation. It will be appreciated that processes such as these are preferably carried out on spent liquor from which essentially all fibrids have been removed. We have found that the coagulating and regenerating liquor does not need to contain, and preferably contains little or no, auxiliary coagulating substances such as the zinc sulphate used in many processes for the manufacture of conventional viscose fibres. Furthermore, the presence of such substances in the fibrids produced by the method of the invention may be undesirable in some end-uses, for environmental and/or technical reasons. If desired, the liquor may contain conventional surface-active agents as employed in other viscose processes.

The temperature of the coagulating and regenerating liquor is preferably in the range from 60 to 100° C., more preferably in the range from 80 to 95° C. Use of high temperatures makes for rapid coagulation and regeneration and assists removal of byproduct carbon disulphide and hydrogen sulphide by degassing. Degassing may be assisted by injecting steam into the slurry resulting from mixing step (1). Such sulphur-containing byproducts may be collected or disposed of in conventional manner.

The mixing step (1) is conveniently carried out by injecting both the viscose and the coagulating and regenerating liquor into a high-shear mixing chamber, for example a Y-shaped chamber, or mixing head, although any method of mixing which generates sufficient turbulence and shear to produce the desired fibrids may be employed. We have found that, in contrast to known methods of forming fibrids, the method of the invention permits the formation of fibrids of the desired morphology even when the viscose is mixed with a coagulating and regenerating liquor which contains a high proportion of preformed fibrids.

The method of the invention may be carried out batchwise or continuously.

For batchwise operation, the invention provides a method for the manufacture of cellulosic fibrids by the viscose process, including the steps of:

(1') providing (a) a batch of viscose and (b) a batch of coagulating and regenerating liquor;

(2') adding the viscose, until addition thereof is complete, to the coagulating and regenerating liquor under conditions such that the viscose and the liquor mix under turbulent conditions, thereby forming a suspension of cellulosic fibrids in liquor, and ultimately forming a suspension of cellulosic fibrids in a spent liquor; and (3') collecting the fibrids from the spent liquor, characterised in that the suspension of cellulosic fibrids in liquor formed in step (2') is recirculated so as to constitute at least part of the coagulating and regenerating liquor supplied into step (2').

At the start of batchwise operation, the coagulating and regenerating liquor contains no fibrids. The quantity of fibrids in the liquor increases throughout the operation until the whole of the viscose has been introduced, and the desired quantity of fibrids in the resulting suspension or slurry has been obtained. The nature of the liquor changes progressively from coagulating and regenerating liquor at the start to spent liquor at the end. The whole of the coagulating and regenerating liquor may be introduced into the mixing circuit at the commencement of step (2'). Alternatively, only a part of this liquor may be introduced at commencement and the balance introduced during the performance of this step (2'). Further alternatively, concentrated coagulating and regenerating liquor may be introduced during performance of step (2') to maintain the composition of the coagulating and regenerating liquor supplied into step (2') as desired.

For continuous operation, the invention provides a method for the manufacture of cellulosic fibrids by the viscose process, including the steps of:

(1") mixing together (a) viscose and (b) a coagulating and regenerating liquor under turbulent conditions, thereby forming a suspension of cellulosic fibrids in a spent liquor; and (2") collecting the fibrids from the spent liquor, characterised in that part of the suspension formed in step (1") is recirculated to form part of the coagulating and regenerating liquor supplied into step (1"). In one version of this embodiment, fibrid suspension is taken for recirculation directly from the suspension formed in step (1"). In an alternative version of this embodiment, the suspension of cellulosic fibrids in a spent liquor resulting from step (1") is classified into two streams of differing fibrid concentration. The stream of higher fibrid concentration is supplied into the collection step (2"), and the stream of lower fibrid concentration is recirculated into mixing step (1").

In continuous operation, conditions are preferably adjusted such that the concentration of fibrids in the coagulating and regenerating liquor supplied into step (1") is from 0.1 to 0.5 percent by weight less than the concentration of fibrids in the suspension in spent liquor resulting from that step. Similar considerations apply to batchwise operation.

In both batchwise and continuous operation, the fibrids may be collected from the spent liquor by any convenient means such as settling, filtration or centrifugation. Filtration, for example on a continuous wire-mesh belt, may be preferred.

The method of the invention may be operated so that the quantity of fibrids in the suspension or slurry supplied into the collection step is in the range from 0.1 to 10 percent by weight. Preferably, the quantity of fibrids in this suspension or slurry is in the range from 1 to 10, more preferably from 2 to 5, percent by weight. It is an advantage of the invention that it permits the ready manufacture of slurries containing high concentrations of fibrids.

It is generally desirable to wash the collected fibrids free of acid. In a preferred embodiment of the invention, an alkali such as sodium hydroxide is added to the slurry supplied to the collection step to adjust its pH towards neutrality, for example in the range from 4 to 8. Neutral salts such as sodium sulphate are more readily removed by washing from regenerated cellulose than are acids or alkalis. It may be preferred to at least partially dewater the slurry before neutralisation, in the interests of economy.

The collected fibrids may be dried if required; although in general it is preferable not to do so, but instead to collect and store fibrids in the form of a cake containing about 10–25, often about 10–20, percent by weight solids.

The spent liquor is preferably recovered by conventional means such as evaporation and crystallisation for reintroduction into the mixing step.

Fines are an undesirable component in materials such as fibrids. They tend to pass through coarse filters and to block fine filters and to be difficult to remove by centrifugation. Furthermore, the presence of fines is undesirable in end-uses such as papermaking. In the method of the invention, fines may serve as nuclei for coagulation on recirculation into the mixing step, whereby the proportion of fines in the final product is reduced.

The cellulose in the viscose may be chemically modified (other than by xanthation). For example, alkali cellulose may be reacted with a cationising agent such as 3-chloro-2-hydroxypropyltrimethylammonium chloride to produce a cationised cellulose which can subsequently be made into viscose. Alternatively, the viscose may contain an additive whose presence is desired in the ultimate fibrids. Examples of such additives include cationic polymers. A preferred example of a cationic fibrid is one which contains a poly (vinylamine) as cationic polymer, as disclosed in EP-A-0, 692,599. Such fibrids may contain from 10 to 50, often from 10 to 25, percent of cationic polymer by weight on cellulose. By such means, cationic fibrids useful as additives in papermaking, for example to assist in web (sheet) formation or in sludge dewatering, can be produced. Other examples of additives which may be included in the viscose include dyestuffs (including optical brightening agents) and pigments (including UV-active pigments).

Fibrids produced by the method of the invention may be used in the manufacture of paper and board, including fine and speciality papers.

The invention is illustrated by the following Example in which parts and proportions are by weight.

EXAMPLE

A batch of conventional viscose (9% cellulose, 5.4.% alkalinity, ballfall viscosity 50 seconds, ripeness 10–12°Ho) (1 part) may be diluted with water (3 parts). The diluted viscose may be injected at ambient temperature through a nozzle of 3 mm diameter at about 500 ml/min into a mixing chamber as first stream. A stirred collecting vessel containing 50 l or 2.7% aqueous sulphuric acid at 80° C. may be disposed below the mixing chamber. The contents of the vessel may be injected through a nozzle of 4 mm diameter at 5–6 l/min into the mixing chamber as second stream to impinge at an angle of 120° with the first stream. The two streams mix under turbulent conditions to yield precipitated cellulose fibrids and the combined stream is diverted perpendicularly to the plane of the first and second streams into the collecting vessel. The second stream initially consists only of aqueous sulphuric acid. While injection of the batch of diluted viscose continues, the concentration of acid in the collecting chamber and consequently in the second stream progressively falls and correspondingly the concentration of soluble products of the reaction between acid and viscose and of precipitated fibrids progressively increases. The temperature of the vessel may be maintained at 80° C. or above by steam injection. Once injection of the batch of viscose is complete, stirring may be continued to effect degassing of the suspension of fibrids in spent liquor now contained in the collecting chamber. This suspension may contain for example 2 or 5 percent by weight fibrids. The fibrids may be collected by centrifugation and washed to form a cake containing for example 10 to 20 percent by weight fibrids.

Alternatively, the diluted viscose may be injected continuously into the mixing chamber, fresh aqueous sulphuric acid added continuously to the collecting chamber or to the second stream, and fibrid-containing suspension continuously extracted from the collection chamber and submitted to centrifugation.

Instead of dilution with water, the viscose may be diluted with an aqueous solution of a cationic polymer such as the poly(vinylamine) Catiofast PR8106 (Trade Mark of BASF AG) so that the diluted viscose contains cellulose and cationic polymer in weight ratio 88:12, in order that cationic fibrids may be produced.

What is claimed is:

1. A method for the manufacture of cellulosic fibrids by the viscose process, including the steps of:

(1) mixing together (a) viscose and (b) a coagulating and regenerating liquor under turbulent conditions, thereby forming a suspension of cellulosic fibrids in a spent liquor;

(2) injecting steam into the suspension of cellulosic fibrids in spent liquor; and (3) collecting the fibrids from the spent liquor, in which method the coagulating and regenerating liquor supplied into step (1) contains cellulosic fibrids withdrawn from step (1).

2. A method for the batchwise manufacture of cellulosic fibrids by the viscose process, including the steps of:

(1') providing (a) a batch of viscose and (b) a batch of coagulating and regenerating liquor;

(2') adding the viscose, until addition thereof is complete, to the coagulating and regenerating liquor under conditions such that the viscose and the liquor mix under turbulent conditions, thereby forming a suspension of cellulosic fibrids in liquor, and ultimately forming a suspension of cellulosic fibrids in a spent liquor;

(3') injecting steam into the suspension of cellulosic fibrids in spent liquor; and (4') collecting the fibrids from the spent liquor, in which method the suspension of cellulosic fibrids in liquor formed in step (2') is recirculated so as to constitute at least part of the coagulating and regenerating liquor supplied into step (2').

3. A method for the continuous manufacture of cellulosic fibrids by the viscose process, including the steps of:

(1") mixing together (a) viscose and (b) a coagulating and regenerating liquor under turbulent conditions, thereby forming a suspension of cellulosic fibrids in a spent liquor;

(2") injecting steam into the suspension of cellulosic fibrids in spent liquor; and (3") collecting the fibrids from the spent liquor, in which method part of the suspension formed in step (1") is recirculated to form part of the coagulating and regenerating liquor supplied into step (1").

4. A method according to claim 1, wherein the cellulose content of the viscose is in the range from 1 to 4 percent by weight.

5. A method according to claim 1, wherein the coagulating and regenerating liquor is an aqueous liquor containing from 0.5 to 5 percent by weight of sulphuric acid.

6. A method according to claim 1, wherein the temperature of the coagulating and regenerating liquor is in the range from 60 to 100° C.

7. A method according to claim 1, wherein the mixing step is performed by injecting both the viscose and the coagulating and regenerating liquor into a high-shear mixing chamber.

8. A method according to claim 1, wherein the suspension of cellulosic fibrids in spent liquor supplied into the collection step contains an amount of fibrids in the range from 0.1 to 10 percent by weight.

9. A method according to claim 1, which further includes the step of adding sodium hydroxide to the suspension resulting from the mixing step to adjust the pH of the suspension to a value in the range from 4 to 8.

10. A method according to claim 1, wherein the viscose contains a cationic polymer.

11. A method according to claim 10, wherein the fibrids produced by the method contain from 10 to 50 percent by weight of the cationic polymer based on the weight of cellulose.

12. A method according to claim 1, wherein the viscose contains at least one component selected from the group consisting of a dyestuff and a pigment.

13. A method according to claim 1, wherein the collected fibrids resulting from the collecting step are in the form of a cake containing an amount of solids in the range from 10 to 25 percent by weight.

14. A method according to claim 5, wherein the aqueous liquor contains from 1 to 3.5 percent by weight of sulphuric acid.

15. A method according to claim , wherein the temperature of the coagulating and regenerating liquor is in the range from 80 to 95° C.

16. A method according to claim 8, wherein the suspension of cellulosic fibrids in spent liquor supplied into the collection step contains an amount of fibrids in the range from 1 to 10 percent by weight.

17. A method according to claim 16, wherein the suspension of cellulosic fibrids in spent liquor supplied into the collection step contains an amount of fibrids in the range from 2 to 5 percent by weight.

18. A method according to claim 10, wherein the cationic polymer is a poly(vinylamine).

19. A method according to claim 11, wherein the fibrids produced by the method contain from 10 to 25 percent by weight of the cationic polymer based on the weight of cellulose.

* * * * *

UNITED STATES PATENT AND TRADEMARK OFFICE

CERTIFICATE OF CORRECTION

PATENT NO. : 6,515,121 B1 
DATED : February 4, 2003
INVENTOR(S) : Andrzej Marek Mackiewicz, Guy Edward Scudder and Sabine Seddon It is certified that error appears in the above-identified patent and that said Letters Patent is hereby corrected as shown below:

Column 7,
Line 1, "to claim wherein the" should read -- to claim 6 wherein the --

Signed and Sealed this

Seventeenth Day of June, 2003

JAMES E. ROGAN
*Director of the United States Patent and Trademark Office*